US009260893B1

(12) United States Patent
Ruspil

(10) Patent No.: US 9,260,893 B1
(45) Date of Patent: Feb. 16, 2016

(54) WINDOW LOCK

(75) Inventor: Mathew D. Ruspil, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 81 days.

(21) Appl. No.: 13/275,404

(22) Filed: Oct. 18, 2011

Related U.S. Application Data

(63) Continuation-in-part of application No. 12/755,642, filed on Apr. 7, 2010, now Pat. No. 8,727,393.

(60) Provisional application No. 61/169,826, filed on Apr. 16, 2009.

(51) Int. Cl.

| | |
|---|---|
| ***E05C 3/16*** | (2006.01) |
| ***E05C 1/10*** | (2006.01) |
| *E05C 1/08* | (2006.01) |
| *E05C 1/04* | (2006.01) |
| *E05C 7/00* | (2006.01) |

(52) U.S. Cl.
CPC ... *E05C 1/10* (2013.01); *E05C 1/04* (2013.01); *E05C 1/08* (2013.01); *E05C 2007/007* (2013.01)

(58) Field of Classification Search
USPC ..... 292/163, 175, 145, 146, 153, DIG. 20, 292/DIG. 47, 152
See application file for complete search history.

(56) References Cited

U.S. PATENT DOCUMENTS

| | | | | |
|---|---|---|---|---|
| 348,657 | A * | 9/1886 | Briggs | 292/169.16 |
| 1,133,962 | A * | 3/1915 | Hoglund | 292/164 |
| 2,141,088 | A * | 12/1938 | McFarlane | 292/177 |
| 2,533,023 | A * | 12/1950 | Lickteig | 292/169.15 |
| 2,546,703 | A * | 3/1951 | Scanlan | 292/170 |
| 2,580,237 | A * | 12/1951 | McConnell | 292/169.16 |
| 2,586,900 | A * | 2/1952 | Alderman | 292/74 |
| 2,587,695 | A * | 3/1952 | Citso | 292/175 |
| 2,621,951 | A * | 12/1952 | Ostadal | 292/169.15 |
| 2,657,946 | A * | 11/1953 | Erkkila | 292/169.17 |
| 2,752,186 | A * | 6/1956 | Morrison | 292/139 |
| 3,240,039 | A * | 3/1966 | Baermann | 70/71 |
| 3,440,844 | A * | 4/1969 | Constable | 70/70 |
| 3,469,875 | A * | 9/1969 | Ahlgren | 292/175 |
| 3,786,657 | A * | 1/1974 | Loikitz | 70/150 |
| 4,917,416 | A * | 4/1990 | Westphal et al. | 292/175 |
| 5,028,083 | A * | 7/1991 | Mischenko | 292/175 |
| 5,062,671 | A * | 11/1991 | Goetz et al. | 292/175 |
| 5,243,783 | A * | 9/1993 | Schmidt et al. | 49/181 |
| 5,425,560 | A * | 6/1995 | Andersen et al. | 292/163 |
| 5,553,903 | A * | 9/1996 | Prete et al. | 292/163 |
| 5,618,067 | A * | 4/1997 | Carlson et al. | 292/175 |
| 5,669,180 | A * | 9/1997 | Maier | 49/181 |
| 5,806,900 | A * | 9/1998 | Bratcher et al. | 292/137 |
| 6,948,278 | B1 * | 9/2005 | Schultz | 49/185 |
| 7,118,142 | B2 * | 10/2006 | Xu | 292/139 |
| 7,407,199 | B2 * | 8/2008 | Richardson | 292/163 |
| 7,441,813 | B2 * | 10/2008 | Qin et al. | 292/163 |
| 7,520,541 | B1 * | 4/2009 | Lawrence | 292/175 |

(Continued)

*Primary Examiner* — Kristina Fulton
*Assistant Examiner* — Faria Ahmad
(74) *Attorney, Agent, or Firm* — Robert Curcio; DeLio, Peterson & Curcio, LLC

(57) ABSTRACT

The invention relates to a window lock having a trigger and a bolt, the trigger being rotatable about an axis of rotation and the bolt being movable between a locked position, a first unlocked position and a second unlocked position. The bolt also includes a clip that engages first and second stops. The trigger rotates about the axis for engaging and disengaging the clip with the first and second stops. The first and second stops and the clip are all located on the same side of the axis of the trigger.

21 Claims, 14 Drawing Sheets

(56) References Cited

U.S. PATENT DOCUMENTS

| | | | | |
|---|---|---|---|---|
| 7,591,494 | B2 * | 9/2009 | Mitchell | 292/336 |
| 8,002,317 | B2 * | 8/2011 | Satram et al. | 292/336 |
| 8,414,039 | B2 * | 4/2013 | Liang et al. | 292/240 |
| 8,870,244 | B2 * | 10/2014 | Liang et al. | 292/173 |
| 2004/0195843 | A1 * | 10/2004 | Rotondi et al. | 292/121 |
| 2005/0146143 | A1 * | 7/2005 | Lutfallah | 292/153 |
| 2007/0205610 | A1 * | 9/2007 | Mazej et al. | 292/152 |
| 2008/0012357 | A1 * | 1/2008 | Liang et al. | 292/240 |
| 2008/0129054 | A1 * | 6/2008 | Tremble et al. | 292/33 |
| 2009/0179436 | A1 * | 7/2009 | Sagalara et al. | 292/174 |
| 2010/0117378 | A1 * | 5/2010 | Seo et al. | 292/163 |
| 2010/0207403 | A1 * | 8/2010 | Bourgoin et al. | 292/335 |
| 2011/0221211 | A1 * | 9/2011 | Weron et al. | 292/64 |
| 2011/0298225 | A1 * | 12/2011 | Liang et al. | 292/175 |

* cited by examiner

WINDOW LOCK

CROSS REFERENCE TO RELATED APPLICATIONS

This patent application is a continuation-in-part application of U.S. Patent Application Ser. No. 12/755,642, filed on Apr. 7, 2010, which claims priority to and the benefit of U.S. Provisional Patent Application No. 61/169,826 filed Apr. 16, 2009, titled "Window Lock," which incorporated herein by reference in its entirety.

FIELD OF THE INVENTION

The invention relates to a lock mechanism for a window assembly.

BACKGROUND OF THE INVENTION

A double-hung, single hung, and double slider window assembly typically includes a window frame and a pair of window sashes mounted for vertical reciprocal sliding movement, one relative to the other, in guide rails of the master frame jamb of the window assembly.

A traditional lock mechanism of the prior art, for a double hung window assembly usually includes one part of the lock on one sash and another part of the lock on the other sash, wherein joining the two parts of the lock mechanism together results in locking the sashes to one another.

One disadvantage of this type of lock mechanism is that it normally requires the sashes be a certain distance away from one another. When the sashes are too close to one another or too far apart the lock mechanism may be ineffective. For example, if the sashes are spaced too far apart, the two parts of the lock mechanism may not be able to be joined together and the window sashes may not be locked. If the sashes are too close to one another, the parts of the lock mechanism may bind or interfere with one another, resulting in the parts not being able to mate together and therefore the window sashes may not be locked. When these problems occur during installation, the installer must adjust the window sashes and lock mechanism, numerous times, before achieving a proper fit between the sashes and lock mechanism. These problems may also occur over time when windows become old, warped, or damaged through normal wear and tear.

As a result of the foregoing disadvantage, the lock mechanism and/or window sashes may need to be replaced without any assurance that the problems will not reoccur. In addition, forcibly pushing the sashes together in order to bring them to a proper distance may result in stress upon the frame around the sashes and/or the glass panes. Continuing to use the lock mechanism and window sashes in this fashion can exacerbate the problems.

What is desired, therefore, is a window lock that is more flexible to use than traditional lock mechanisms. Another desire is to provide a window lock that accommodates changes in the spacing between the sashes. A further desire is to provide a window lock that is more resistant to damage than the traditional locking mechanism without sacrificing reliability. Yet another desire is to provide a window lock that works for sashes that have a varying distance between them. Another desire is to provide a window lock that automatically locks the sashes when they are brought together.

SUMMARY OF INVENTION

It is therefore an object of the invention to provide a window lock that overcomes the above-described disadvantages of the prior art.

Another object is to provide a window lock that functions properly when encountering variances in the spacing between the sashes.

A further object is to provide a window lock that automatically locks the window sashes without user intervention.

These and other objects are achieved by providing a window lock mechanism having a trigger and a bolt, the trigger being rotatable about an axis and the bolt being movable from a locked position to an unlocked position. The bolt includes a first clip and a second clip and the trigger includes a stop and a ramp. The trigger rotates about the axis for engaging and disengaging the ramp and the stop with the first and second clips which move the bolt between the locked and unlocked positions.

In some embodiments, the first and second clips are positioned on a beam and the beam cantilevers from the bolt.

In some embodiments, the trigger includes at least one axle for rotation about an axis. In other embodiments, the first and second clips and the stop are located between a first axle and a second axle.

In another embodiment, the trigger further includes a ramp for engaging the first clip to inhibit movement of the bolt and holding the bolt in a first unlocked position. In other embodiments, the stop engages with the second clip for holding the bolt in a second unlocked position. In some of these embodiments, the stop rotates about a pivot point toward the beam for engaging with the second clip.

In a further embodiment, a first distance is defined by movement of the bolt from the locked position to the unlocked position and a second distance is defined by movement of the bolt from the first to second unlocked positions. The second distance is less than the first distance.

In yet another embodiment, engagement of the trigger with a strike causes the stop to rotate about the axis and disengage from the second clip, wherein disengagement permits a bolt spring to bias the bolt toward the locked position.

In one case, the ramp engages a top surface of the first clip for flexing the beam relative to the bolt thus allowing the stop to disengage from and pass over the second clip. In another case, the beam flexes about a pivot point at the juncture of the bolt and the beam.

In another aspect of the invention, the window lock includes a trigger and a bolt. The trigger is rotatable about an axis and has a stopper selected from the group consisting of a stop, a ramp, and combinations thereof. The bolt is movable from a locked position to an unlocked position and has a clip. The trigger rotates about the axis for engaging and disengaging the stopper with the clip for moving the bolt between the locked and unlocked positions.

In a further aspect of the invention, a method for locking and unlocking a window lock includes the steps of providing a trigger with a stop and a ramp, providing a bolt with a first clip and a second clip, the bolt is movable between a locked position and an unlocked position. The method also includes engaging and disengaging the ramp and the stop with the first clip and the second clip for locking and unlocking the window lock.

In some embodiments, the method rotates the trigger about an axis of rotation for causing the ramp to engage with the first clip for holding the bolt in the first unlocked position.

In other embodiments, the method rotates the trigger about the axis for causing the ramp to disengage from the first clip, thereby permitting the bolt to move from the first unlocked position toward the locked position; and causing the stop to engage with the second clip for holding the bolt in the second unlocked position.

In further embodiments, the method causes the trigger to rotate about the axis for disengaging the stop from the second unlocked position, thereby permitting the bolt to move from the second unlocked position toward the locked position.

In another aspect of the invention, a method for locking and unlocking a sliding window includes the steps of providing a window having two sashes that are slideable relative to each other in parallel planes; and providing a bolt on a first sash, the bolt being movable between a locked and two unlocked positions. The method also moves the bolt a first distance away from the second sash to a first unlocked position, whereby the first sash is slideable with respect to the second sash. The method also includes the step of moving the first sash with respect to the second sash, whereby the bolt moves a second distance to a second unlocked position, the second distance being less than the first distance.

In some embodiments, the method moves the first sash with respect to the second sash, whereby the bolt moves towards the second sash to the locked position, automatically locking the window.

In some embodiments, two clips are provided which act against two corresponding stop surfaces to hold the bolt in the first and second unlocked positions. In another embodiment, a single clip acts against two stop surfaces to hold the bolt in the two unlocked positions. In some embodiments, the stop surfaces are connected to the trigger on the stop and the ramp and are located on opposite sides of the axis of rotation of the trigger. In other embodiments, one stop surface may move with the trigger and the other stop surface may be fixed and mounted to the chassis.

In another embodiment, the window lock includes:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger rotatable about an axis, the trigger including a first stop with a corresponding first stop surface;

a second stop having a second stop surface;

the first and second stop surfaces and the clip surface all being positioned on the same side of the axis of the trigger;

the clip cooperating with the first and second stops to hold the bolt in the first and second unlocked positions, respectively; and the trigger positioning the first stop to hold the bolt in the first unlocked position, the trigger rotating about the axis in a first direction to allow the bolt to move from the first unlocked position to the second unlocked position and the trigger rotating about the axis in an opposite direction to allow the bolt to move from the second unlocked position to the locked position.

In one aspect of this embodiment, corresponding to other embodiments, the clip is positioned on a beam and the beam is cantilevered from the bolt. The beam flexes along its length and/or about a pivot point at a juncture of the bolt and the beam.

In another aspect of the invention, the clip surface is forward facing and the first and second stop surfaces are rearward facing. The clip preferably includes a rearward facing ramp surface that acts to raise the clip relative to the first stop as the bolt is moved from the locked position to the first unlocked position so that the clip surface may move from a location forward of the first stop surface to a location rearward of the first stop surface to engage the first stop surface with the bolt in the first unlocked position.

The first and second stops may also be provided with respective forward facing ramp surfaces to assist in flexing the beam and raising the clip relative to the first and/or the second stops.

In yet another aspect of the invention, the clip is provided with a single clip surface that is wider than the first stop. A first portion of the clip surface engages with the first stop surface when the bolt is in the first unlocked position and a second portion of the clip surface, adjacent to the first portion, engages with the second stop surface when the bolt is in the second unlocked position. In this embodiment, the first and second stop surfaces are offset in a forward/rearward direction relative to each other to control the distance the bolt moves between the first and second unlocked positions.

In a preferred design, the second stop is mounted approximately adjacent to, but offset in a forward direction relative to the first stop and the clip surface is wider than the first stop surface. The clip surface engages the first stop surface along a first portion of the clip surface width when the bolt is in the first unlocked position and engages the second stop surface along a second portion of the clip surface width when the bolt is in the second unlocked position.

In a further aspect of this embodiment, the second stop is mounted fixed relative to the chassis. It may be mounted directly to the chassis or to a component mounted to the chassis.

In still another aspect, a first distance is defined by a length of movement of the bolt from the locked position to the first unlocked position. A second distance is defined by a length of movement of the bolt from the second unlocked position to the locked position, and the second distance is less than the first distance.

The invention is also directed to a method for locking and unlocking window sashes, including the steps of:

mounting two window sashes relative to each other in generally parallel planes, the two sashes moving between an open and a closed position;

providing a window lock and installing the window lock on a first sash, the window lock including:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger rotatable about an axis, the trigger including a first stop with a corresponding first stop surface; and a second stop having a second stop surface;

wherein the first and second stop surfaces and the clip surface are all positioned on the same side of the axis of the trigger;

installing a strike on the second sash, the strike including a strike opening for receiving the bolt and preventing relative movement of the window sashes;

moving the bolt a first distance away from the second sash to the first unlocked position when the sashes are in the closed position to engage the clip surface with the first stop surface and hold the bolt in the first unlocked position;

moving the first sash with respect to the second sash from the closed position towards the open position;

rotating the trigger in a first direction as the first sash moves away from the closed position towards the open position and thereby releasing the bolt from the first unlocked position to move to the second unlocked position and engage the clip surface with the second stop surface to hold the bolt in the second unlocked position;

moving the first sash with respect to the second sash from the open position to the closed position; and rotating the trigger in an opposite direction from the first direction as the first sash reaches the fully closed position and thereby releasing the bolt from the second unlocked position to the locked position to engage the strike.

DETAILED DESCRIPTION OF THE INVENTION

Figure 1:
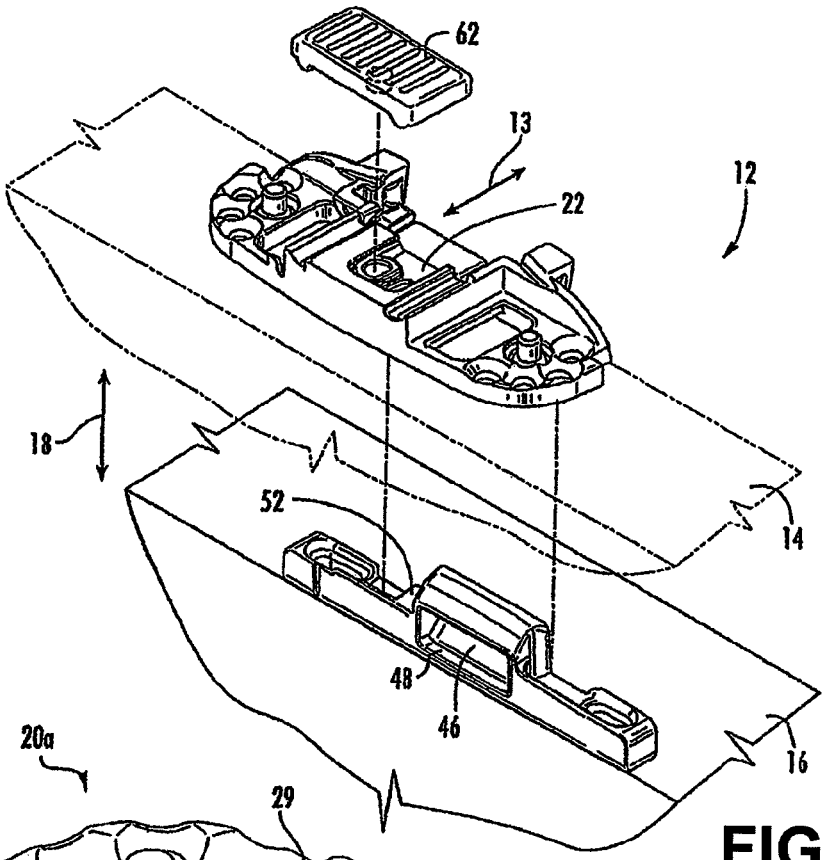
FIG. 1 depicts an isometric view of an embodiment of the window lock in accordance with the invention.

As shown in FIGS. 1, 2A, 2B, 4, and 5, window assembly 12 includes sashes 14, 16 that slide in parallel planes relative to one another in the direction of arrows 18, either vertically or horizontally. In the example used in the drawings, a vertically sliding window sash assembly is shown. (References to direction or movement up or down are with respect to the vertically sliding window sash example; for horizontally sliding window sashes these directions refer to right or left.) A lock 20 is attached to the adjacent sash portions 14 and 16 and includes a bolt 22 and a trigger 24 on a first lock portion 20*a* mounted on sash 14. Bolt 22 includes a first clip 26, a second clip 28, a beam 30, and pivot point 32 and where trigger 24 includes stop 34, axle 36, and ramp 38. Depending on the position of trigger 24 (explained below), bolt 22 moves in a direction normal to the planes of the sashes in direction of arrows 13, toward and away from sash 16. A second lock portion 20*b* is mounted on sash 16 and includes a strike 44 having an orifice 46 that may receive the end of bolt 22 to lock the sashes from relative sliding movement.

The positions of bolt 22 and trigger 24 relative to each other enable bolt 22 to lock and unlock sliding movement of the sashes 14 and 16. More particularly, the engagement or disengagement of ramp 38 with first clip 26 holds or releases bolt 22 from a first unlocked position at a spaced distance away from strike 44 to permit opening of the window. The engagement or disengagement of stop 34 with second clip 28 holds or releases bolt 22 from a second unlocked position, which is closer to strike 44 but still spaced to permit relative sliding movement of the sashes. Where bolt 22 is not held in the first or second unlocked position, bolt 22 is permitted to pass to the locked position where it is engaged with orifice 46 of strike 44 to restrict sash movement and lock the window.

As shown in FIGS. 7-14, the invention generally includes the following steps to operate the lock while opening and closing the window: window closed and locked (bolt engaged with strike); window closed but unlocked (bolt moved away from strike and not engaged); window open and unlocked (trigger begins to rotate due to spring bias); window open and unlocked (trigger rotation complete due to spring bias); and window closed and trigger about to release bolt, permitting bolt to return to locked position shown in first step.

As shown and described herein and in FIGS. 3 and 7-14, trigger 24 rotates about axis of rotation R for engaging and disengaging ramp 38 and stop 34 with first and second clips 26, 28, respectively, for moving bolt 22 between the locked and unlocked positions.

Figure 7:
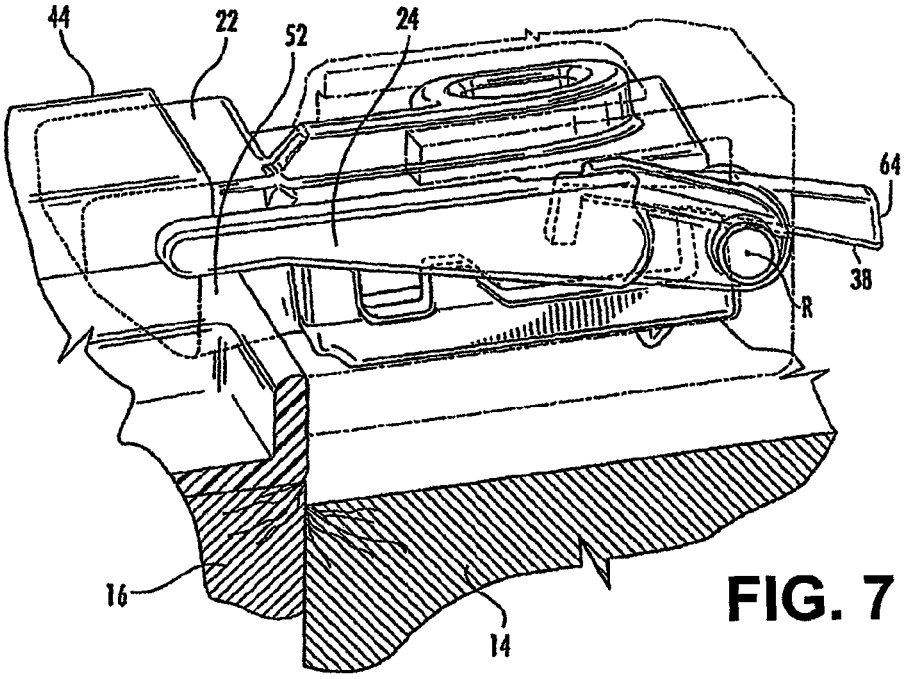
FIG. 7 depicts an isometric view of the trigger and bolt shown in FIG. 1, where the trigger and bolt are in a locked position with the window closed.

When the window is closed and locked, as shown in FIG. 7, bolt 22 is in the locked position and engaged with strike 44 by extending into orifice 46, wherein window 12 is inhibited from opening because bolt 22 would come in contact with edge 48 of strike 44. Tip 50 of trigger 24 is in contact with plateau 52 of strike 44.

The locked position shows that bolt 22 is in the left position while trigger 24 is inhibited from further rotation in the counterclockwise position because of physical contact with plateau 52, wherein further counterclockwise rotation is possible if trigger 24 were moved away from plateau 52. In the orientation shown in FIGS. 7-14, bolt 22 is permitted to move left (locked position) to right (unlocked positions), and vice versa. Trigger 24 is permitted to rotate about axis of rotation R but does not translate or move left, right, up, or down unless such movement is associated with the rotation and/or because bolt 22 is moving left or right. Bolt spring 54 biases bolt 22 toward the locked position and trigger spring 56 biases trigger 24 in a counterclockwise rotational direction.

Trigger 24 rotates clockwise or counterclockwise about axis of rotation R and does not itself move in any linear direction, such as left, right, up, or down. In some embodiments shown in FIGS. 3 and 5, axle 36 is divided into two separate axles 36*a*, 36*b* that are placed in hole 58 and clip 60, both of which are mounted on chassis 23.

Figure 3:
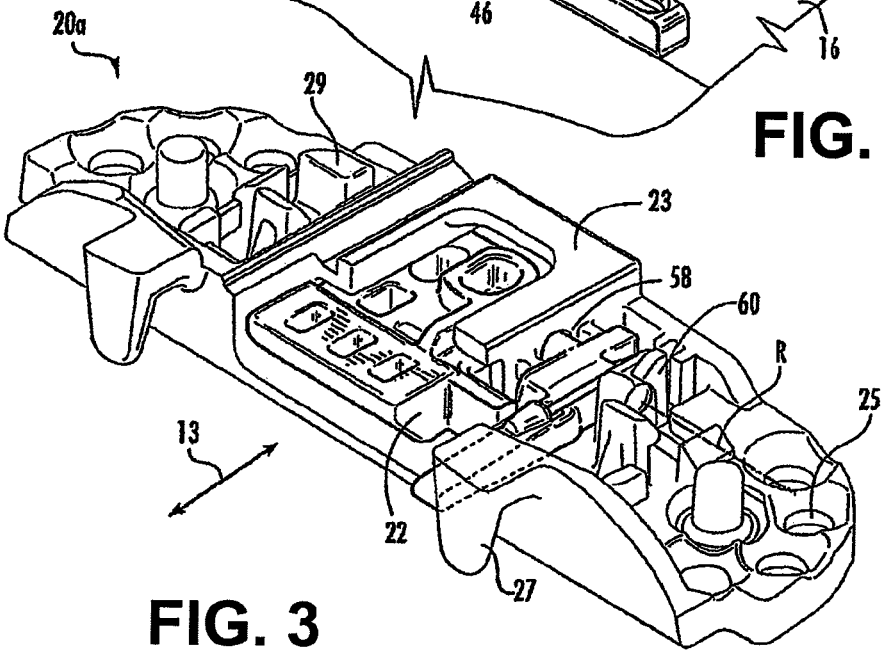
FIG. 3 depicts an isometric view of the window lock without the cover shown in FIG. 1.
Figure 2A:
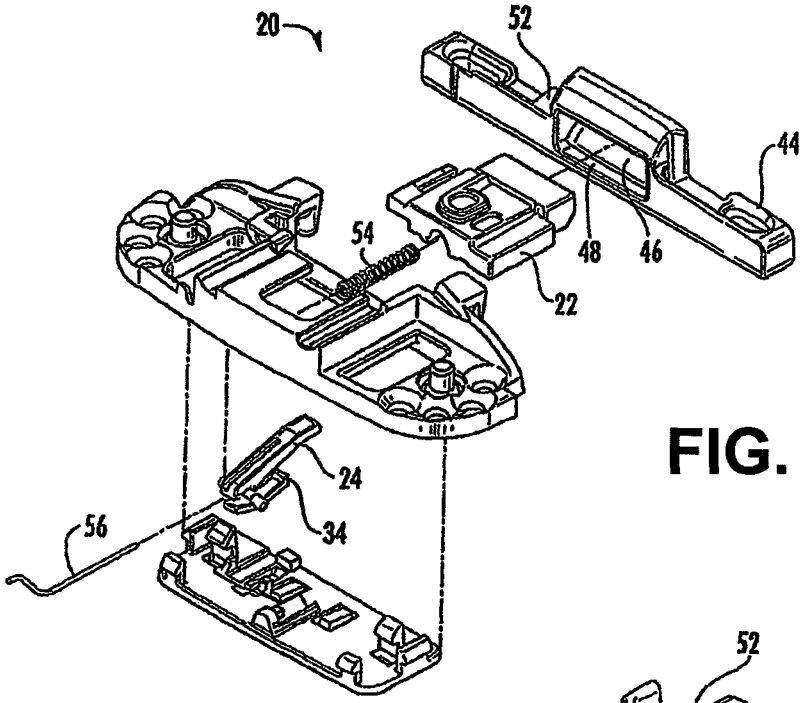
FIG. 2A depicts an exploded view of the window lock shown in FIG. 1.
Figure 2B:
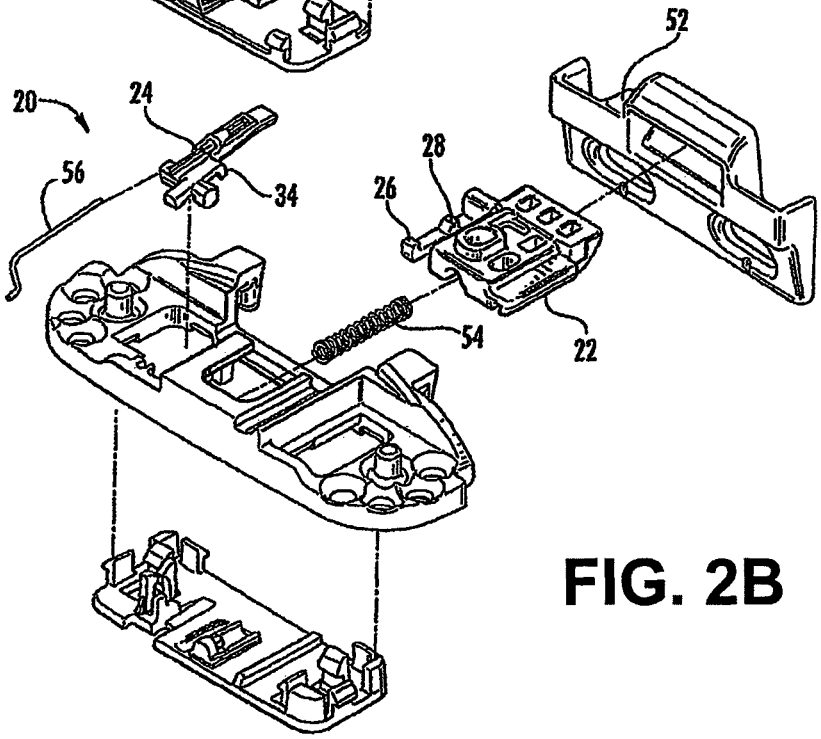
FIG. 2B depicts an exploded view of another embodiment of the window lock shown in FIG. 1.
Figure 4:
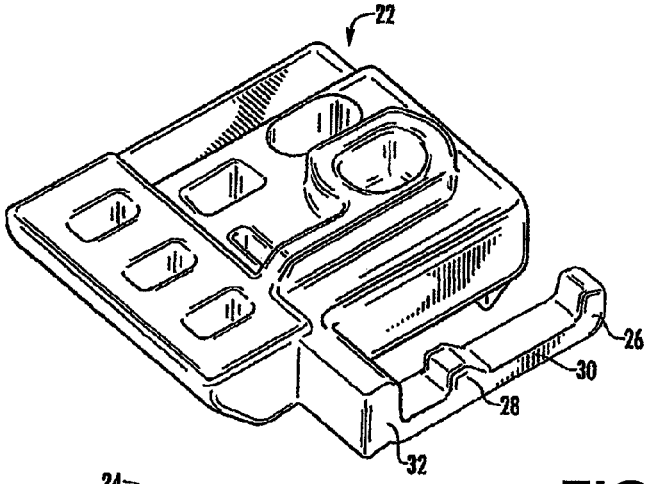
FIG. 4 depicts an isometric view of the bolt shown in FIG. 1.
Figure 5:
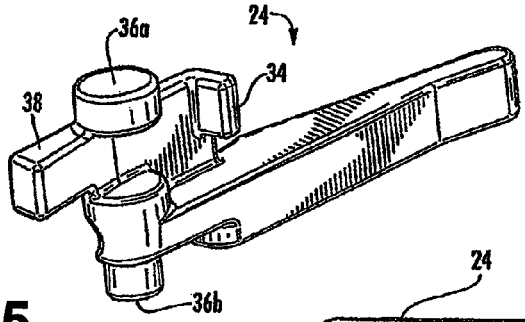
FIG. 5 depicts an isometric view of the trigger shown in FIG. 1.
Figure 6:
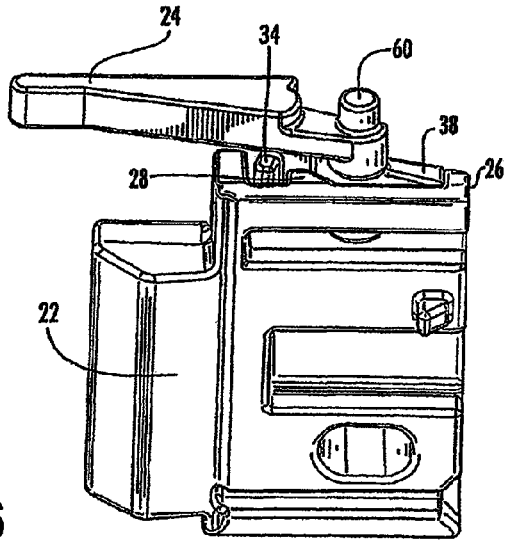
FIG. 6 depicts a bottom view of the trigger and bolt shown in FIG. 1.

As shown in FIG. 3, chassis 23 includes a plurality of studs 29 and orifices 25 for mounting other structure, such as clip 60, bolt 22, and trigger 24. In addition, chassis 23 includes grips 27 for absorbing stress from window sashes 14, 16 being locked and unlocked together.

As shown in FIGS. 3-6, axles 36*a*, 36*b* together rotate about axis R and first clip 26, second clip 28, stop 34, ramp 38, and beam 30 are all located between axles 36*a*, 36*b*. In this fashion, movement of bolt 22 does not interfere with axle 36, and vice versa, which means the left or right movement of the bolt does not cause any part of bolt 22 to hinder rotation of axle 36. Therefore, trigger 24, including stop 34 and ramp 38, does not affect the movement of bolt 22 except when engaged with first or second clips 26, 28.

To unlock window 12, a user moves a finished handle or button 62 to the unlocked position, where the handle or button is connected to bolt 22. When bolt 22 is initially moved to the unlocked positions (right direction) shown in FIG. 8, the window is still in the closed position, in which case tip 50 of trigger 24 is still in contact with plateau 52. In this position, bolt 22 is moved toward the right, away from strike 44, resulting in the window being permitted to open.

Figure 8:
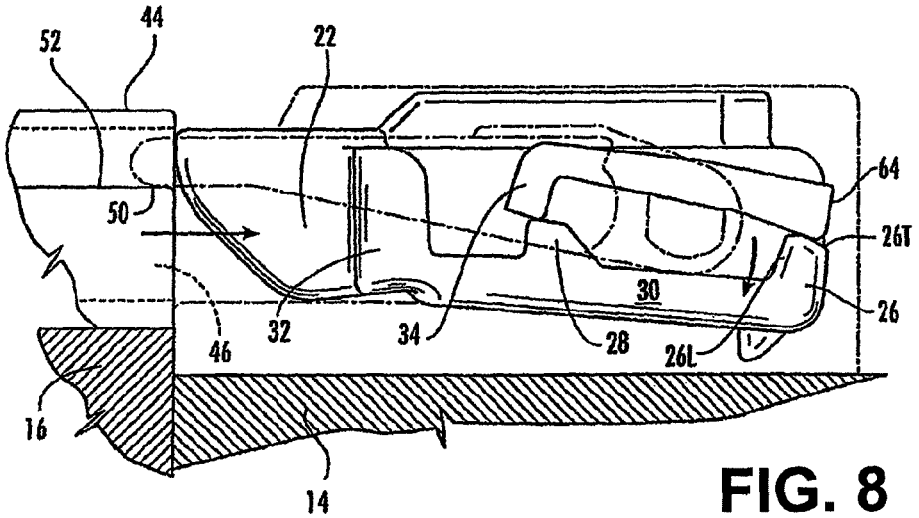
FIG. 8 depicts a side view of the trigger and bolt shown in FIG. 1, where the bolt is moving toward an unlocked position and the window is closed.
Figure 9:
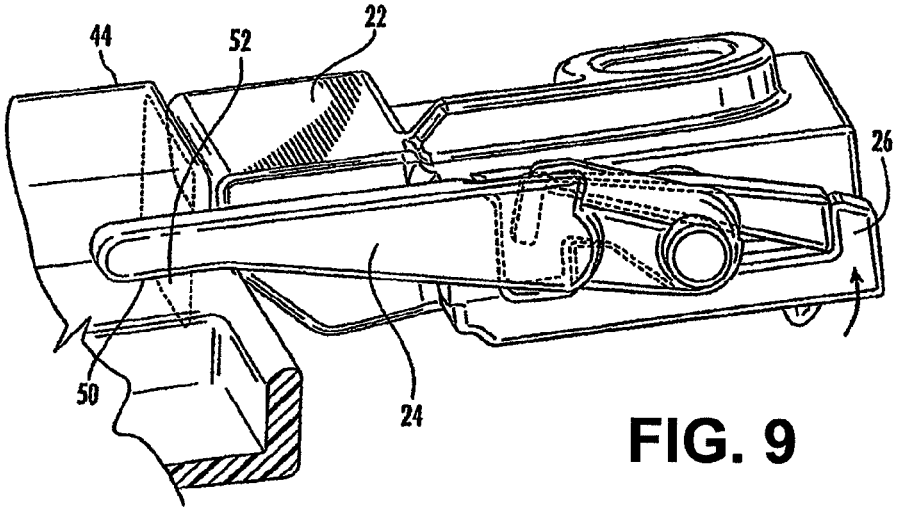
FIG. 9 depicts an isometric view of the trigger and bolt shown in FIG. 1, where the bolt is in an unlocked position and the window is closed.
Figure 10:
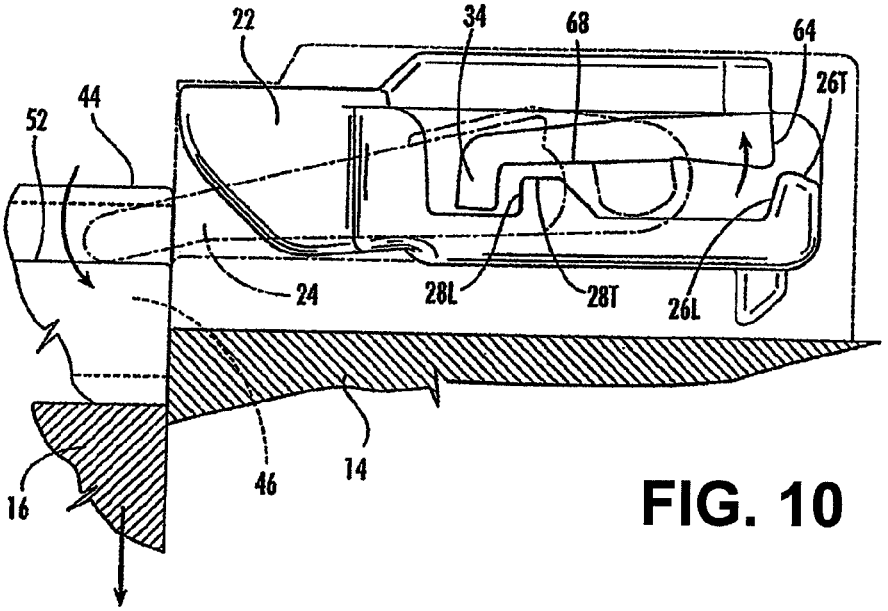
FIG. 10 depicts a side view of the trigger and bolt shown in FIG. 1, where the trigger and bolt are in an unlocked position and the window is just opened.

As shown from FIG. 7 to FIG. 9, top surface 26T of first clip 26 slides along ramp 38 until top surface 26T passes over butt 64, resulting in ramp 38 engaging with left side 26L of first clip 26. In this position, butt 64 holds bolt 22 in a first unlocked position and inhibits bolt spring 54 from biasing bolt 22 toward the locked position (left position). Concurrently, second clip 28 passes under stop 34 without right side 28R of second clip 28 coming in contact with stop 34 because of contact between ramp 38 with top surface 28T and contact between tip 50 with plateau 52.

When ramp 38 slides along top surface 28T, the gradually increasing thickness or downward sloping decline of ramp 38 causes beam 30 to flex or pivot about pivot point 32 (see FIG. 8 for beam 30 rotating downwardly or clockwise about pivot point 32). When butt 64 or ramp 38 completes its pass over top surface 28T, beam 30 flexes or pivots up (see FIG. 9 for beam 30 rotating upwardly or counterclockwise about pivot point 32). Once rotated upward, left side 64L engages butt 66.

Figure 11:
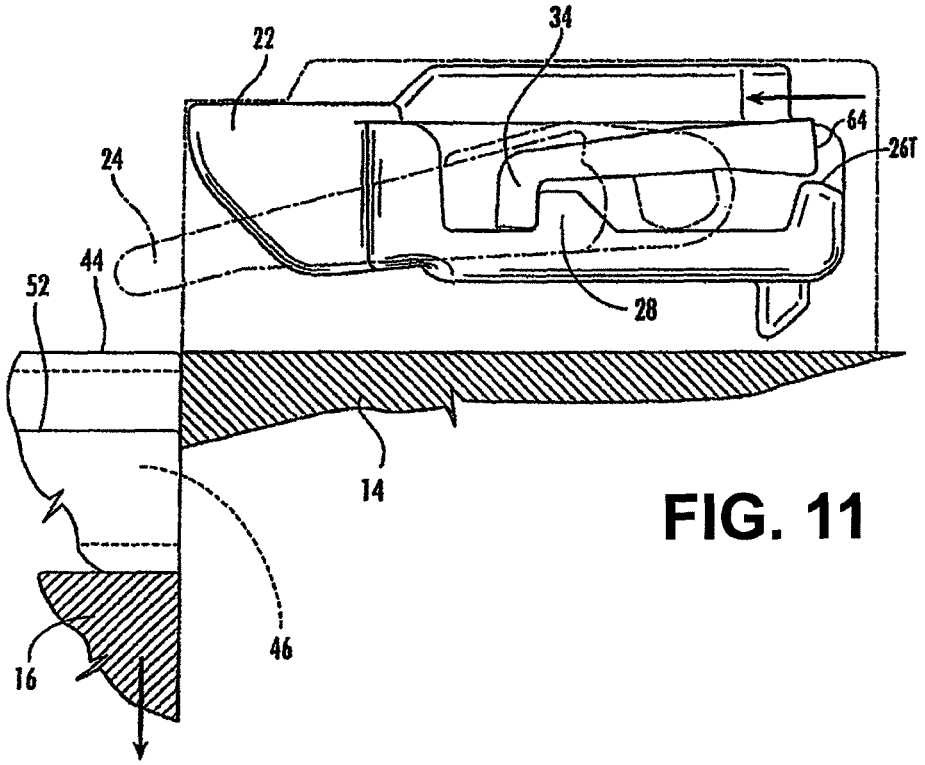
FIG. 11 depicts a side view of the trigger and bolt shown in FIG. 1, where the trigger and bolt are in an unlocked position and the window is fully opened.

In a next step, the user opens window by moving sashes 14, 16 to slide them relative to each other. As a result and in reference to FIG. 10, tip 50 moves away from plateau 52 and this allows trigger spring 56 to bias trigger 24 in a counterclockwise direction until belly 68 of trigger 24 contacts top surface 28T of second clip 28. During the counterclockwise rotation, butt 64 disengages from left side 26L of first clip 26, which releases bolt 22 from the first unlocked position and allows bolt spring 54 to bias bolt 22 toward the locked position (left position and bolt 22 moving leftwards shown in FIG. 11). However, because of the counterclockwise rotation of trigger 24, stop 34 engages with left side 28L of second clip 28 before bolt 22 biases leftwards any further (as shown in FIG. 11), wherein bolt 22 biases a relatively modest or small distance after butt 64 disengages from left side 26L of first clip 26. Due to the small leftward movement of bolt 22 when ramp 38 or butt 64 disengages from left side 26L and when stop 34 engages with left side 26L, at least a part of first clip 26 and at least a part of top surface 26T are moved under ramp 38. See FIG. 11. When stop 34 engages with left side 28L of second clip 28, bolt 22 is held in the second unlocked position. As shown, the modest or small distance bolt 22 moves from the first unlocked position to the second unlocked position is less than a distance bolt 22 moves from the locked position shown in FIG. 7 to the first unlocked position.

Figure 12:
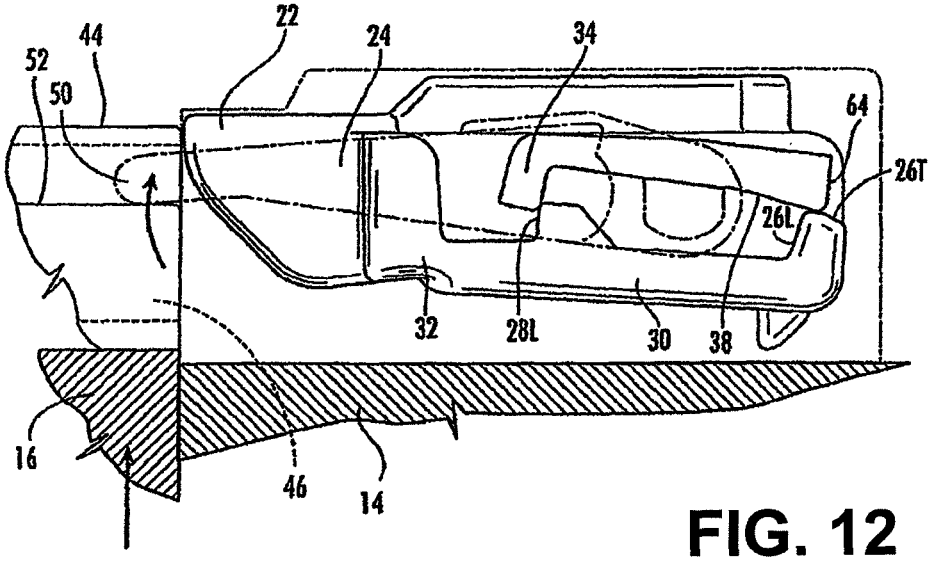
FIG. 12 depicts a side view of the trigger and bolt shown in FIG. 1, where the window is just closed and trigger is moving toward a locked position and the bolt is still in an unlocked position.

In a next step shown in FIG. 12, lock 20 automatically locks window assembly 12 when sashes 14, 16 are brought together without user intervention. More particularly, as window 12 approaches a closed position (almost closed), tip 50 comes in contact with plateau 52 and causes trigger 24 to rotate clockwise about axis R as window continues to close. As trigger 24 rotates clockwise, ramp 38 comes in contact with top surface 26T and, because of this, butt 64 does not engage or contact left side 26L, which would hinder bolt 22 from moving to the locked position. As trigger 24 rotates clockwise, stop 34 disengages, or rotates upward, away from left side 28L of second clip 28. Because stop 34 is no longer holding bolt 22 in the secondary locked position (FIG. 13), bolt spring 54 is permitted to bias bolt 22 to the locked or left most position (FIG. 14), thereby locking lock 20 and window 12 automatically without user intervention.

Referring again to FIG. 12, because tip 50 is in contact with plateau 52 and ramp 38 is in contact with top surface 26T, stop 34 does not engage with second clip 28 as bolt 22 moves leftward to the locked position. Therefore, as bolt 22 moves to the locked position, ramp 38 slides along top surface 26T and stop 34 passes over second clip 28. Once stop 34 passes over second clip 28, the invention is in the position shown in FIG. 7.

Figure 13:
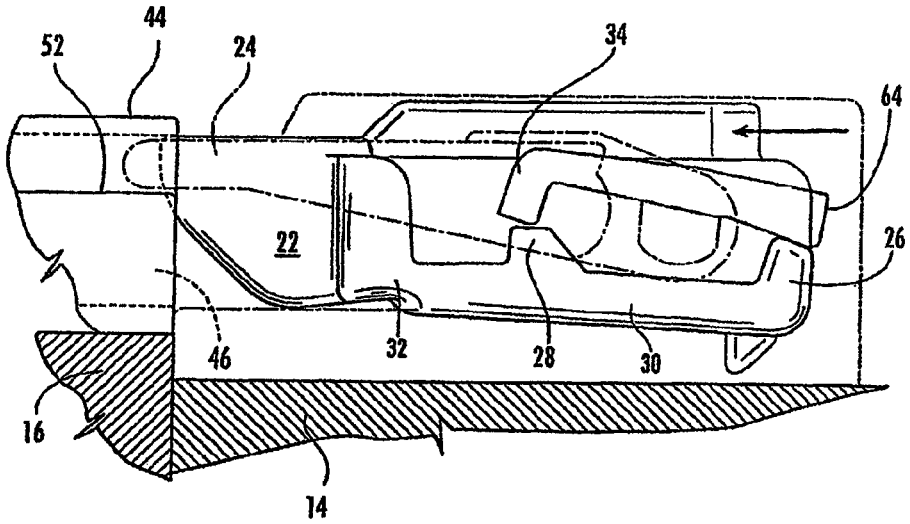
FIG. 13 depicts a side view of the trigger and bolt shown in FIG. 1, where the window is closed and the bolt is automatically moving toward the locked position.
Figure 14:
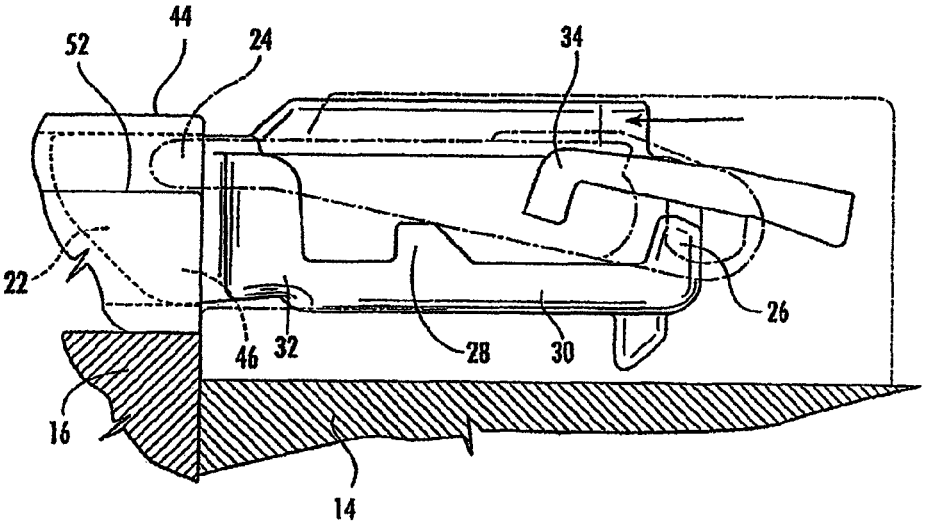
FIG. 14 depicts a side view of the trigger and bolt shown in FIG. 1, where the trigger and bolt are resetting to the locked position shown in FIG. 7.

In some embodiments, the clockwise rotation of trigger 24 causes ramp 38 to not only slide along top surface 26T but also presses down upon top surface 26T, which causes beam 30 to flex downward or away from trigger 24 at pivot point 32 (FIGS. 12 and 13). In some of these embodiments, once stop 34 passes over second clip 28, beam 30 flexes back (FIG. 14) to its original position shown in FIG. 7. In other embodiments, beam 30 cantilevers from pivot point 32 located on bolt 22.

In a further embodiment, stop 34 engages and disengages with second clip 28 in alternating fashion, or alternately, as ramp 38 engages and disengages with first clip 26. In other words, to the extent bolt 22 is in any unlocked position or to the extent bolt 22 is approaching or being released from any unlocked position shown in FIGS. 7-14, if stop 34 is engaged with second clip 28, ramp 38 is disengaged from first clip 26. Moreover, to the extent bolt 22 is in any unlocked position or to the extent bolt 22 is approaching or being released from any unlocked position shown in FIGS. 7-14, if stop 34 is disengaged with second clip 28, ramp 38 is engaged with first clip 26.

In another embodiment, stop 34 engages with and disengages from a single clip, whether it be first clip 26, second clip 28, or another clip centrally located between first and second clips. In this embodiment, ramp 38 does not engage or disengage with any part of bolt 22, including first clip 26. In these embodiments, the invention is effectively reduced to a single clip and stop 34 engages and disengages from one another to lock and unlock window assembly 12 by holding bolt 22 in the locked position and releasing bolt 22 so that bolt spring 54 can bias bolt 22 to the unlocked position.

In other embodiments, ramp 38 engages with the single clip as described above and stop 34 is not engaging or disengaging with any part of bolt 22. In these embodiments, the invention is effectively reduced to the single clip and ramp 38 that engage and disengage from one another to lock and unlock window assembly 12 by holding bolt 22 in the locked position and releasing bolt 22 so that bolt spring 54 can bias bolt 22 to the unlocked position.

In some of these embodiments, trigger 24 has a stopper for engaging with bolt 22, wherein the stopper is selected from the group consisting of stop 34, ramp 38, and combinations thereof.

It is understood that the above-described invention properly operates in either one of two orientations of trigger 24 and beam 30 and the corresponding clips on beam 30. In one embodiment, shown in FIG. 2A, stop 34 and ramp 38 are facing in an upward direction and clips 26, 28 are facing in a downward direction. In another embodiment shown in FIG. 2B, stop 34 and ramp 38 are facing in a downward direction and clips 26, 28 are facing in an upward direction. Lock 20 locks and unlocks as described herein with trigger 24 and bolt 22 positioned in either one of the embodiments shown in FIG. 2A or 2B.

Referring generally to FIGS. 17-21 another embodiment of the invention can be seen. This embodiment operates in a similar way to the embodiments previously described, but uses different structure to achieve that functionality. A bolt 122, slidably mounted in chassis 123, is biased towards a locked position with a bolt spring 154. As in the other embodiments, the bolt in this design has a locked position and two unlocked positions. In the locked position, the bolt engages the strike and the window is locked so that the first and second sashes cannot move relative to each other.

The lock mechanism seen in FIGS. 17-21 is mounted on a first sash and a strike is mounted on a second sash in the same manner previously described. The strike and sashes have been omitted for clarity. In the two unlocked positions, the bolt is retracted against biasing force supplied by the bolt spring 122 and cannot engage the strike. In the first unlocked position the bolt is slightly farther from the strike than when it is in the second unlocked position.

Figure 18:
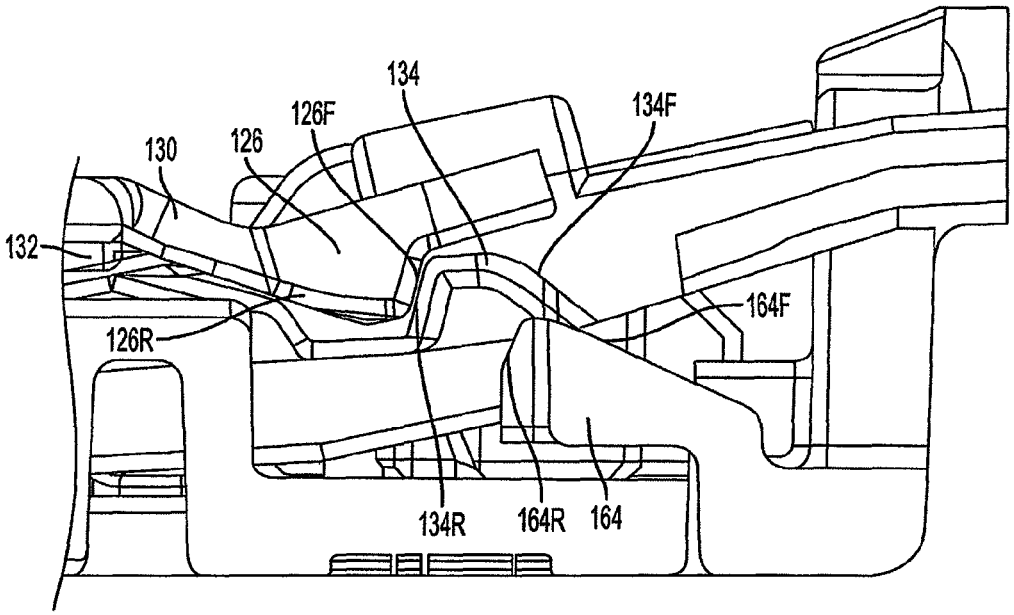
FIG. 18 depicts a cross sectional detail view corresponding to FIG. 17, where the trigger is still up, the bolt has been moved to a first unlocked position and the window is still fully closed.

A trigger 124 is biased to rotate in a first direction by a trigger spring 156 (see FIG. 18). The trigger includes a tip 150 which contacts the strike on the opposing window sash (or it may directly contact the second sash). The trigger is used to detect whether the window is closed or opened.

To open the window from the locked position, the user initially manually slides the bolt a first distance from the locked position to the first unlocked position by operating a finished handle or button 62 as previously described. When the bolt 122 is disengaged from the strike, the user can open the window. As the window is opened, the trigger is rotated by the trigger spring, which releases the bolt from the first unlocked position and allows it to move a short distance to the second unlocked position.

When the user closes the window, the trigger again rotates as it comes back into contact with the strike. As the bolt becomes aligned with the strike, the motion of the trigger causes it to release the bolt to move a second distance from the second unlocked position to the locked position. The first distance from the locked position to the first unlocked position is greater than the second distance from the second unlocked position to the locked position. In the locked position, the bolt engages the strike.

The complete sequence of events from where the window is closed and the bolt is in the locked position through the stages of unlocking and opening the window to the final return of the window to the closed locked position is shown in the detail views of FIGS. 17-21. These views are cross section views. They look outward and away from the bolt in the direction indicated in FIG. 15 along line 17-17. Thus, the tip 150 of the trigger 124 points to the right in these views. This is in contrast to FIGS. 7-14, which look inward towards the bolt and have the tip of the trigger pointing to the left.

The contact between the tip of the trigger and the strike is essentially the same as was described above in connection with FIGS. 7-14. The opposing strike and sash, the contact point of the tip of the trigger with the strike and the operating button 62 have all been omitted from FIGS. 17-21.

Figure 15:
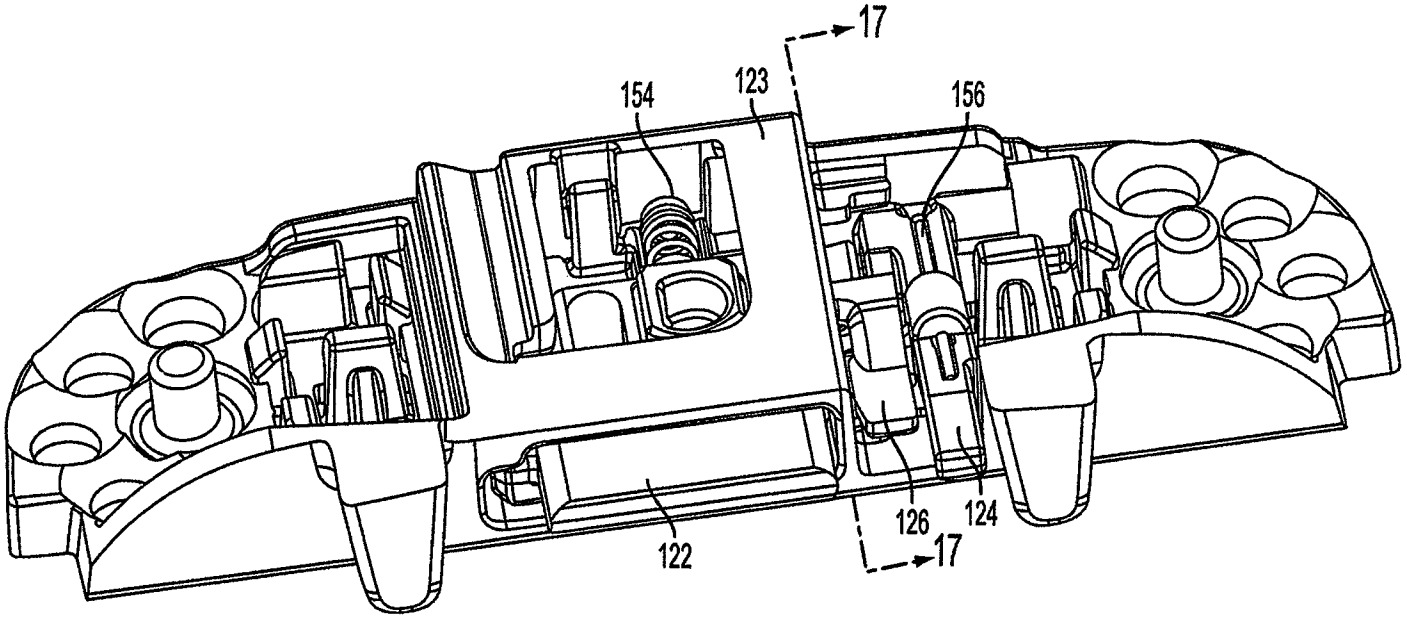
FIG. 15 depicts an isometric view of a third embodiment of the window lock in accordance with the invention.
Figure 16:
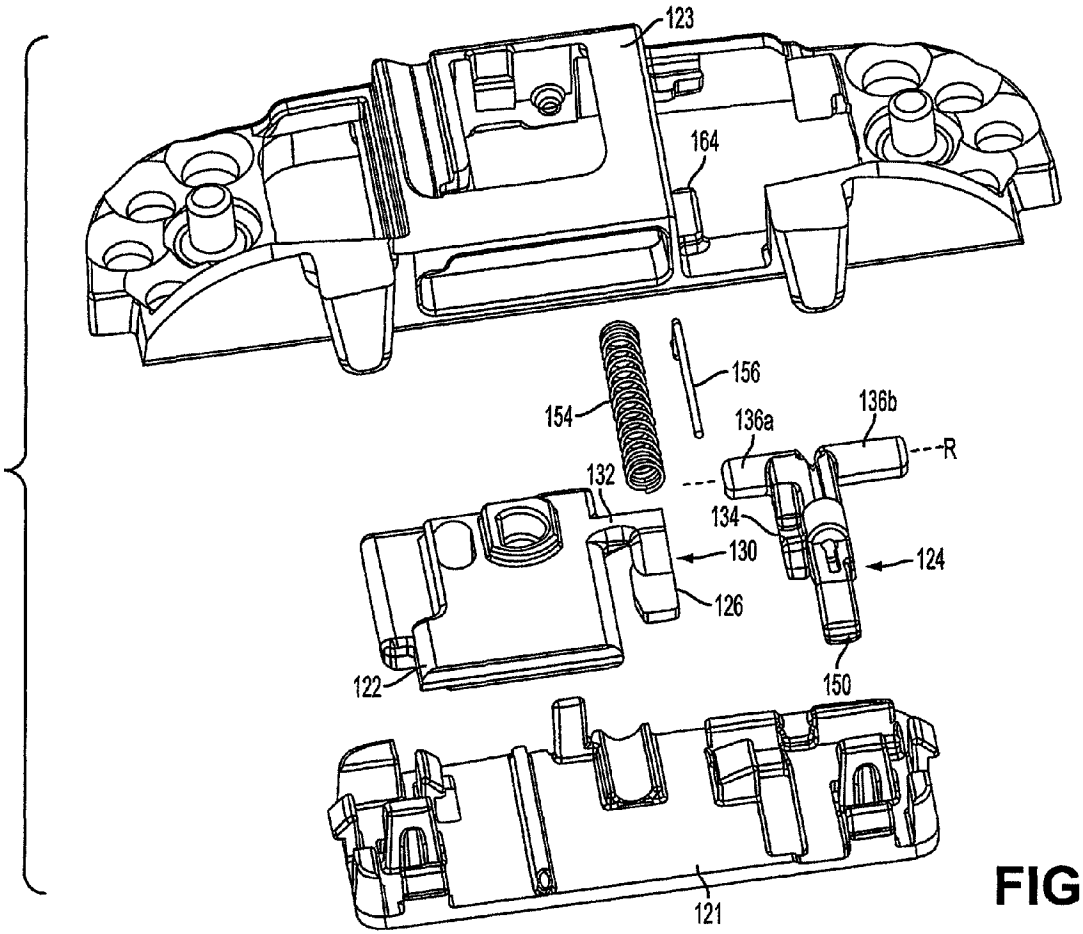
FIG. 16 depicts an exploded isometric view of the window lock shown in FIG. 15.

FIGS. 15 and 16 show six basic components of this embodiment that correspond to the components of the previously described designs. A base 121 snaps into a chassis 123. It will be noted that many variations of the chassis are within the skill of one in the art, and the base may be integrated into the chassis, or constructed of multiple parts, etc.

The bolt 122 slides within the chassis and is biased towards the outwardly extended locked position by bolt spring 154. The trigger 124 rotates about axis R on an axle having two halves 136*a* and 136*b*. Trigger spring 156 biases the trigger to hold the trigger tip 150 down.

The bolt 122 includes a cantilevered beam 130 that flexes about pivot 132. The cross section views of FIGS. 17-21 all cut through the pivot 132 and look away from the bolt. Unlike the previously described designs, the cantilevered beam 130 needs only a single clip 126 instead of first and second clips. The clip 126 on the cantilevered beam 130 has a forward facing clip surface 126F and a rearward facing ramp surface 126R.

The clip 126 interacts with first and second stops 134 and 164. More specifically, the forward facing clip surface 126F on clip 126 contacts the first and second rearward facing stop surfaces 134R and 164R to hold the bolt at the first and second unlocked positions respectively.

The first rearward facing stop surface 134R on the first stop 134 is part of the trigger 124 and it moves up and down with the trigger 124. The second rearward facing stop surface 164R and the second stop 164 are fixed relative to the chassis. The two stop surfaces 134R and 164R are relatively narrow and are located approximately side by side, but offset forward and rearward. The offset is such that the first stop surface 134R is slightly farther from the front of the chassis (and the strike), while the second stop surface 164R is slightly closer to the front of the chassis (and the strike).

The forward facing clip surface 126F is relatively wider than the two stop surfaces 134R, 164R so that it can engage either stop surface. The forward and back offset distance between the two stop surfaces 134R, 164R defines the difference in the first and second unlocked positions of the bolt 122. When the forward facing clip surface 126F engages the rearward facing first stop surface 134R, the bolt is held in the first unlocked position. When clip surface 126F engages the second stop surface 164R, the bolt is held in the second unlocked position.

Because the clip surface 126F is wider than the narrower stop surfaces, two different areas on the clip surface 126F contact the two stop surfaces. If desired, the clip surface may be divided into two relatively narrower clip surfaces, instead of a single wider clip surface, as shown, with each area forming its own clip surface for contacting a respective one of the stop surfaces. This would permit repositioning of the respective clip and stop surfaces, in a design that is more similar to the previously described embodiments.

If the portion of the clip surface that contacts the first stop surface is offset forward or rearward relative to the portion of the clip surface that contacts the second stop surface, the first and second stop surfaces will have to be offset accordingly to compensate.

It will be noted, however, that in the present design, and in such a possible alternative design (with two clip surfaces), both clip surfaces and both stop surfaces will be located on the same side of the rotation axis R of the trigger axle. This is in contrast to the previously described designs in which the trigger ramp 38 and butt 64 are on the opposite side of the axis R from the stop 34 and where the first clip 26 and second clip 28 are widely separated, with the first clip moving beyond the axis R to engage the butt 64 of the ramp 38. Thus the present design, with either one or two clipping surfaces, can be made more compact.

The forward facing clip surface 126F has a vertical angle that is selected so that when it is in contact with one of the two rearward facing stop surfaces 134R or 164R, it will not slip off that stop surface.

The two stops 134, 164 and the clip 126 also have corresponding oppositely facing ramp surfaces. Clip 126 has a rearward facing ramp surface 126R, the first stop 134 has a forward facing ramp surface 134F and the second stop 164 has a forward facing ramp surface 164F. The ramp surfaces are at a shallower angle than the clip and stop surfaces. The angle is chosen so that as the bolt is moved to the rear, the ramp surfaces slide against each other, the beam 130 flexes and the clip 126 moves to the rear of the respective first or second stop to bring the clip surface 126F into position to be stopped by the respective first or second stop surface 134R, 164R.

The details of this operation will now be described starting with FIG. 17 which shows the window closed and the mechanism locked. The trigger 124 is being held up (rotated counterclockwise) against the downward biasing force of the trigger spring 156 by contact between the tip of the trigger 150 and the adjacent strike, in the same manner shown in FIG. 7.

The bolt 122 is fully extended to the right by the bolt spring 154. The pivot 132 (shown in cross section), beam 130 and clip 126, all of which are carried by the bolt 122, are also fully to the right in FIG. 17. The forward facing clip surface 126F of clip 126 is to the right of both rearward facing stop surfaces 134R and 164R and is engaged with neither.

FIG. 18 shows the position of the components after the user has retracted the bolt 122 to the first unlocked position by operating button 62. As the bolt moved to the left, the rearward facing ramp surface 126R caused the clip 126 to ride up and over the two stops 134 and 164. FIG. 18 shows the bolt after it has moved fully to the left along with the first clip 126. The forward facing clip surface 126F is now engaged with the rearward facing first stop surfaces 134R on the trigger. The window has not yet been opened or moved by the user so the trigger 124 remains up, in the same position seen in FIG. 17. Because the trigger is up, the stop surface 134R on the trigger is engaged with the clip surface 126F and is preventing the bolt from moving forward. The bolt is being held in the first unlocked position by this engagement between clip surface 126F and stop surface 134R.

Figure 19:
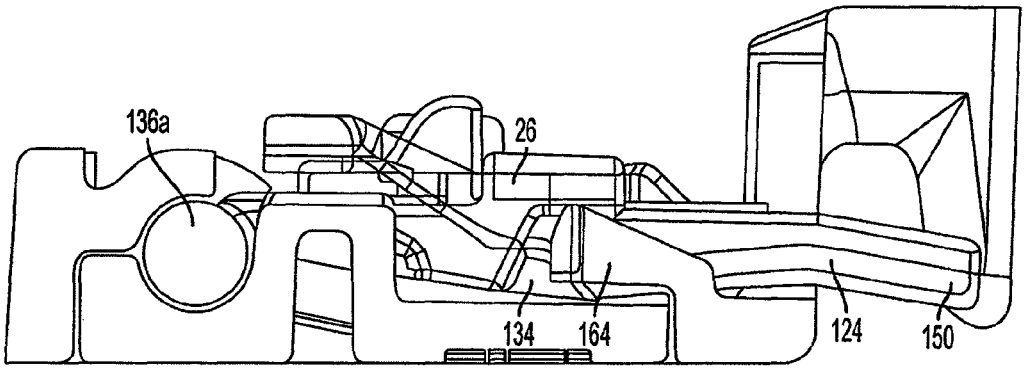
FIG. 19 depicts a cross sectional detail view corresponding to FIG. 17, where the trigger is rotating down as the window begins to open and the bolt is still in the first unlocked position, but is about to move to the second unlocked position

Referring to FIG. 19, the user is now raising the window carrying the lock mechanism, causing it to rise relative to the strike on the other sash to the left. The tip 150 of the trigger is now moving down and the trigger 124 is rotating clockwise, lowering the first stop 134. The stop surface 134R on the first stop is shown just as it is about to disengage from the clip surface 126F.

Figure 20:
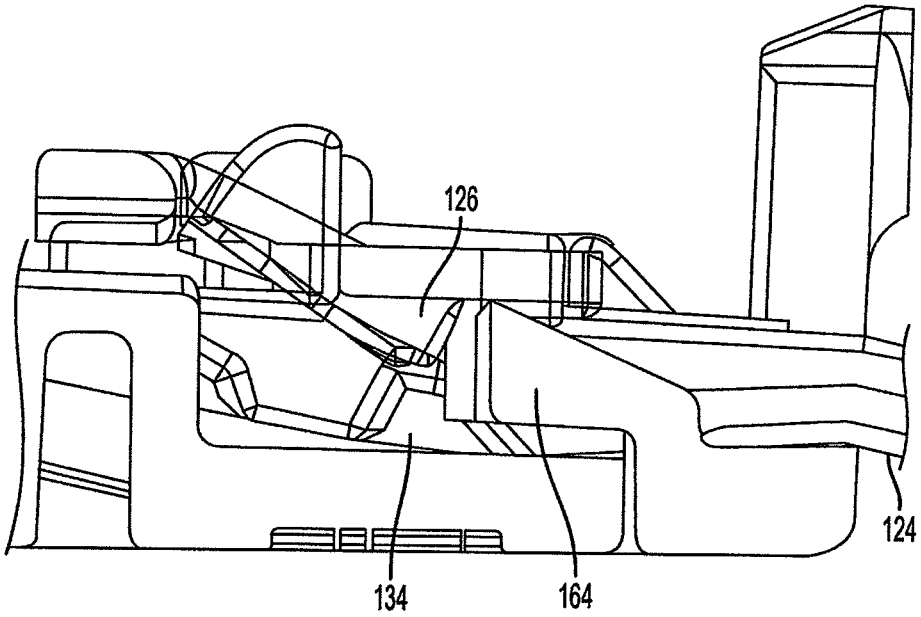
FIG. 20 depicts a cross sectional detail view corresponding to FIG. 17, where the trigger has now rotated fully down as the window has opened and the bolt has moved to the second unlocked position.

FIG. 20 shows the completion of the process begun in FIG. 19. The bolt 122 is now in the second unlocked position. The window has opened sufficiently that the trigger tip 150 is completely down. The trigger 124 has rotated clockwise to its clockwise limit under the downward pressure exerted by the trigger spring 156 and the first stop surface 134R has become disengaged from the clip surface 126F. The clip surface 126F has transitioned from the first stop surface 134R to the second stop surface 164R. The bolt 122 and clip 126 have moved forward a short distance from the first unlocked position to the second unlocked position by the biasing force of the bolt spring.

The lock mechanism remains in the position seen in FIG. 20, with the bolt in the second unlocked position, during the entire time the window is open. The lock mechanism may be said to be cocked, with the bolt spring still compressed and the bolt in the second unlocked position ready to be released by the trigger. The lock mechanism remains in this cocked condition until the window is almost completely closed, as detected by the trigger 124. As the window is closed, the first sash reaches a closed position opposite the second sash and the lock mechanism begins to align the bolt with an opening in the strike on the second sash. Just before the lock and strike reach alignment, the trigger on the first sash will contact the strike on the second sash and will begin to rise.

Figure 21:
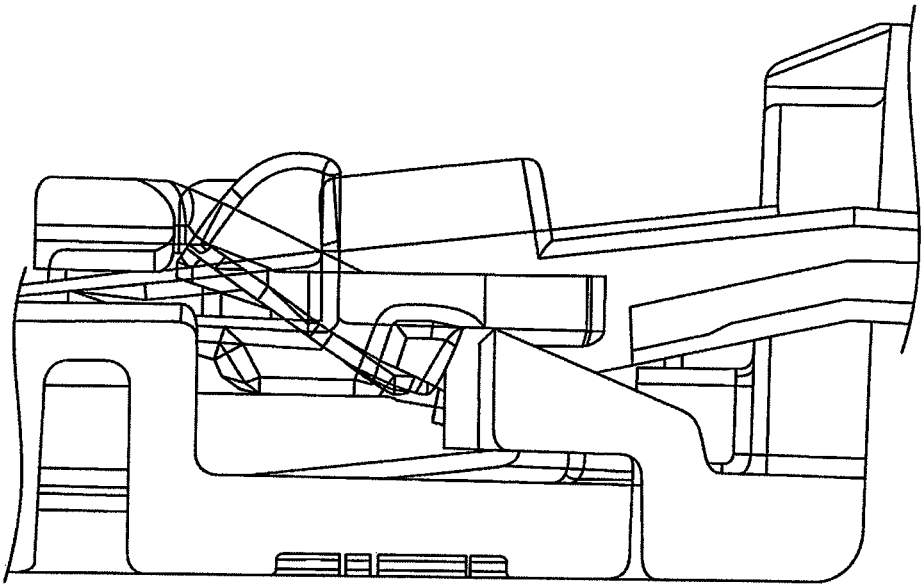
FIG. 21 depicts a cross sectional detail view corresponding to FIG. 17, where the window is still partially open, but is moving towards and has almost reached the closed position. The trigger is moving back up and the bolt is about to be released from the second unlocked position to return to the locked position shown in FIG. 17.

FIG. 21, shows the window as it is nearly closed. The tip 150 of the trigger is being pushed upwards by contact with the opposing strike as the bolt 122 approaches alignment with the strike. As the trigger rises, the top surface of the first stop 134 contacts the bottom of the clip 126 and pushes the clip up, disengaging the forward facing clip surface 126F from the rearward facing stop surface 164R on the second stop 164. This frees the bolt 122 from the second unlocked position and allows the bolt spring 154 to extend the bolt into the strike and automatically lock the window.

Figure 17:
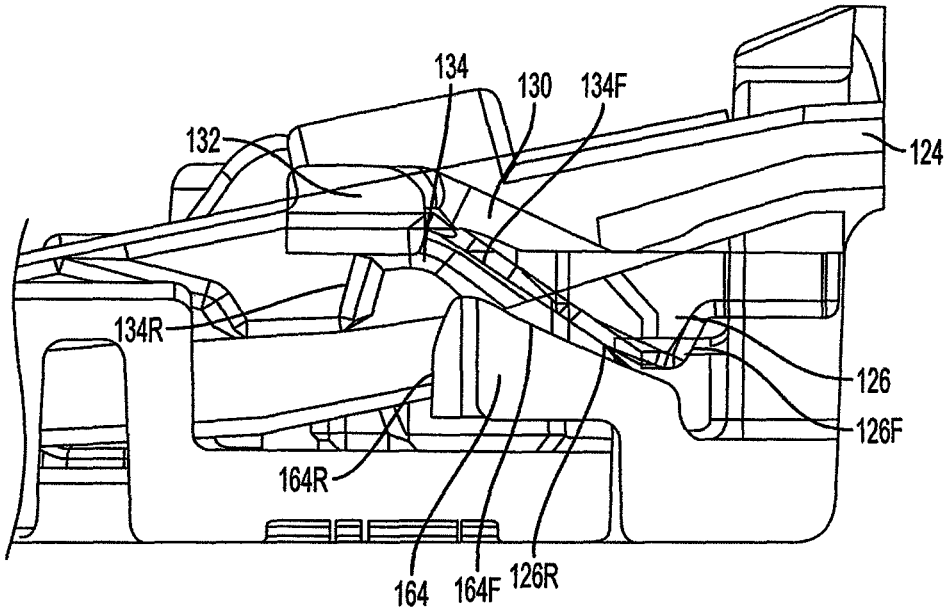
FIG. 17 depicts a cross sectional detail view along the line 17-17 in FIG. 15, where the trigger is up, the bolt is in the locked position and the window is fully closed.

After the bolt has been released, the lock is in the position shown in FIG. 17 and is ready to repeat the cycle described above.

The example described in the drawings is of a window having the sashes move in the vertical or horizontal direction. The window lock described herein may be likewise employed for sliding doors that move in the horizontal direction (or any other relative direction), wherein the lock described herein may be employed to lock an edge of a sliding door with respect to a door jamb or adjacent door. In such case the term window is to be understood to encompass such sliding doors and the term sash is to be understood to encompass such door edges and jambs as well.

The terms "forward" and "rearward," "top" and "bottom," etc., as used herein, must then be interpreted with reference to the new direction of installation or mounting.

Thus, the present invention provides one or more of the following advantages: 1) more flexibility of use than a traditional lock; 2) accommodates changes in the spacing between the sashes; 3) more resistant to damage than a traditional lock without sacrificing reliability; 4) works for sashes that have a varying distance between them; and/or 5) automatically locks the window when the sashes are brought together.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A window lock for locking a window in a locked window position, the window lock comprising:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position, wherein the clip is positioned on a beam and the beam is cantilevered from the bolt, and wherein the beam flexes about a pivot point at a juncture of the bolt and the beam;

a trigger mounted to said chassis and rotatable about an axis as the window moves into and out of the locked window position, the trigger including a first stop with a corresponding first stop surface;

a second stop having a second stop surface;

the first and second stop surfaces and the clip surface all being positioned on the same side of the axis of the trigger;

the clip cooperating with the first and second stops to hold the bolt in the first and second unlocked positions, respectively; and the trigger positioning the first stop to hold the bolt in the first unlocked position, the trigger caused to be rotated about the axis in a first direction as the window moves out of the locked window position to allow the bolt to move from the first unlocked position to the second unlocked position and the trigger caused to be rotated about the axis in an opposite direction as the window moves into the locked window position to allow the bolt to move from the second unlocked position to the locked position.

2. The window lock according to claim 1, wherein the trigger further includes at least one axle for rotation about the axis.

3. The window lock according to claim 1, wherein the clip surface is forward facing and the first and second stop surfaces are rearward facing.

4. A window lock for locking a window in a locked window position, the window lock comprising:

a chassis;

a bolt having at least one clip with a clip surface, the bolt being moveable relative to the chassis from a locked position to a first unlocked position and from the first unlocked position to a second unlocked position, the bolt being biased towards the locked position and releasable from the second unlocked position to the locked position, and wherein the clip further includes a rearward facing ramp surface;

a trigger mounted to said chassis and rotatable about an axis as the window moves into and out of the locked window position, the trigger including a first stop with a corresponding first stop surface;

a second stop having a second stop surface;

the first and second stop surfaces and the clip surfaces all being positioned on the same side of the axis of the trigger, wherein the clip surface is forward facing and the first and second stop surfaces are rearward facing;

the clip cooperating with the first and second stops to hold the bolt in the first and second unlocked positions, respectively; and the trigger positioning the first stop to hold the bolt in the first unlocked position, the trigger caused to be rotated about the axis in a first direction as the window moves out of the locked window position to allow the bolt to move from the first unlocked position to the second unlocked position and the trigger caused to be rotated about the axis in an opposite direction as the window moves into the locked window position to allow the bolt to move from the second unlocked position to the locked position.

5. A window lock for locking a window in a locked window position, the window lock comprising:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger mounted to said chassis and rotatable about an axis as the window moves into and out of the locked window position, the trigger including a first stop with a corresponding first stop surface;

a second stop having a second stop surface;

the first and second stop surfaces and the clip surface all being positioned on the same side of the axis of the trigger, wherein the clip surface is forward facing and the first and second stop surfaces are rearward facing;

the clip cooperating with the first and second stops to hold the bolt in the first and second unlocked positions, respectively, wherein the clip includes a rearward facing ramp surface, and wherein the rearward facing ramp surface on the clip acts to raise the clip relative to the first stop as the bolt is moved from the locked position to the first unlocked position; and the trigger positioning the first stop to hold the bolt in the first unlocked position, the trigger rotating about the axis in a first direction as the window out of the locked window position to allow the bolt to move from the first unlocked position to the second unlocked position and the trigger rotating about the axis in an opposite direction as the window moves into the locked window position to allow the bolt to move from the second unlocked position to the locked position.

6. A window lock for locking a window in a locked window position, the window lock comprising:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger mounted to said chassis and rotatable about an axis as the window moves into and out of the locked window position, the trigger including a first stop with a corresponding first stop surface;

a second stop having a second stop surface;

the first and second stop surfaces and the clip surface all being positioned on the same side of the axis of the trigger, wherein the clip surface is forward facing and the first and second stop surfaces are rearward facing;

the clip cooperating with the first and second stops to hold the bolt in the first and second unlocked positions, respectively, wherein the clip includes a rearward facing ramp surface, and, wherein the first and second stops further include respective forward facing ramp surfaces; and the trigger positioning the first stop to hold the bolt in the first unlocked position, the trigger rotating about the axis in a first direction as the window out of the locked window position to allow the bolt to move from the first unlocked position to the second unlocked position and the trigger rotating about the axis in an opposite direction as the window moves into the locked window position to allow the bolt to move from the second unlocked position to the locked position.

7. The window lock according to claim 4, wherein the clip is wider than the first stop.

8. A window lock for locking a window in a locked window position, the window lock comprising:

a chassis;

a bolt having at least one clip with a clip surface, the bolt being moveable relative to the chassis from a locked position to a first unlocked position and from the first unlocked position to a second unlocked position, the bolt being biased towards the locked position and releasable from the second unlocked position to the locked position;

a trigger mounted to said chassis and rotatable about an axis as the window moves into and out of the locked window position, the trigger including a first stop with a corresponding first stop surface;

a second stop having a second stop surface, wherein the second stop is mounted fixed relative to the chassis;

the first and second stop surfaces and the clip surfaces all being positioned on the same side of the axis of the trigger;

the clip cooperating with the first and second stops to hold the bolt in the first and second unlocked positions, respectively; and the trigger positioning the first stop to hold the bolt in the first unlocked position, the trigger caused to be rotated about the axis in a first direction as the window moves out of the locked window position to allow the bolt to move from the first unlocked position to the second unlocked position and the trigger caused to be rotated about the axis in an opposite direction as the window moves into the locked window position to allow the bolt to move from the second unlocked position to the locked position.

9. A window lock for locking a window in a locked window position, the window lock comprising:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger mounted to said chassis and rotatable about an axis as the window moves into and out of the locked window position, the trigger including a first stop with a corresponding first stop surface;

a second stop having a second stop surface, wherein the second stop is mounted fixed relative to the chassis, and wherein the second stop is mounted approximately adjacent to, but offset in a forward direction relative to the first stop and the clip surface is wider than the first stop surface, the clip surface engaging the first stop surface along a first portion of the clip surface width when the bolt is in the first unlocked position and engaging the second stop surface along a second portion of the clip surface width when the bolt is in the second unlocked position;

the first and second stop surfaces and the clip surface all being positioned on the same side of the axis of the trigger;

the clip cooperating with the first and second stops to hold the bolt in the first and second unlocked positions, respectively; and the trigger positioning the first stop to hold the bolt in the first unlocked position, the trigger rotating about the axis in a first direction as the window out of the locked window position to allow the bolt to move from the first unlocked position to the second unlocked position and the trigger rotating about the axis in an opposite direction as the window moves into the locked window position to allow the bolt to move from the second unlocked position to the locked position.

10. A window lock for locking a window in a locked window position, the window lock comprising:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position, wherein a first distance is defined by a length of movement of the bolt from the locked position to the first unlocked position;

a trigger mounted to said chassis and rotatable about an axis as the window moves into and out of the locked window position, the trigger including a first stop with a corresponding first stop surface;

a second stop having a second stop surface;

the first and second stop surfaces and the clip surface all being positioned on the same side of the axis of the trigger, the clip cooperating with the first and second stops to hold the bolt in the first and second unlocked positions, respectively; and the trigger positioning the first stop to hold the bolt in the first unlocked position, the trigger rotating about the axis in a first direction as the window out of the locked window position to allow the bolt to move from the first unlocked position to the second unlocked position and the trigger rotating about the axis in an opposite direction as the window moves into the locked window position to allow the bolt to move from the second unlocked position to the locked position.

11. The window lock according to claim 10, wherein a second distance is defined by a length of movement of the bolt from the second unlocked position to the locked position, and wherein the second distance is less than the first distance.

12. The window lock according to claim 1 wherein the trigger is biased to rotate about the axis in the first direction with a trigger spring and the bolt is biased towards the locked position with a bolt spring.

13. A window lock for locking a window in a locked window position, the window lock, comprising:

a chassis;

a bolt having a cantilevered beam extending therefrom and a clip on the beam, the clip having a forward facing clip surface and a rearward facing ramp surface, the bolt being slidably mounted in the chassis and movable from a forwardly extended locked position to a first rearward unlocked position and from the first unlocked position to a second rearward unlocked position, the bolt being biased forward with a bolt spring towards the locked position and releasable from the second unlocked position to the locked position;

a trigger mounted to said chassis and rotatable about an axis as the window moves into and out of the locked window position, the trigger including a first stop with a rearwardly facing first stop surface and the trigger being biased to rotate in a first direction about the axis with a trigger spring;

a second stop mounted in a fixed position relative to the chassis, the second stop having a second stop surface;

the first and second stop surfaces and the clip surface all being positioned on the same side of the axis of the trigger;

the clip cooperating with the first and second stops to hold the bolt in the first and second unlocked positions, respectively;

the rearward facing ramp surface on the clip flexing the beam about a pivot point at a juncture of the bolt and the beam to raise the clip relative to the first stop when the bolt is moved rearward from the locked position to the first unlocked position; and the trigger positioning the first stop to hold the bolt in the fiht unlocked position, the trigger spring rotating the trigger about the axis in the first direction caused by window movement as the window moves into the locked window position to disengage the clip surface from the first stop surface and allow the bolt to move from the first unlocked position to the second unlocked position and the trigger caused to be rotated about the axis in an opposite direction as the window moves out of the locked window position to disengage the clip surface from the second stop surface to allow the bolt to move from the second unlocked position to the locked position.

14. A method for locking and unlocking window sashes comprising the steps of:

mounting two window sashes relative to each other in generally parallel planes the two sashes moving between an open and a closed position;

providing a window lock and installing the window lock on a first sash, the window lock including:

a chassis;

a bolt having at least one clip with a clip surface, the bolt being movable relative to the chassis from a locked position to a first unlocked position and from the first unlocked position to a second unlocked position, the bolt being biased towards the locked position and releasable from the second unlocked position to the locked position;

a trigger mounted to said chassis and rotatable about an axis, the trigger including a first stop with a corresponding first stop surface; and a second stop having a second stop surface;

wherein the first and second stop surfaces and the clip surface are all positioned on the same side of the axis of the trigger, wherein the clip surface is forward facing and the first and second stop surfaces are rearward facing, and the clip further includes a rearward facing ramp surface, and wherein the rearward facing ramp surface on the clip acts to raise the clip relative to the first stop as the bolt is moved from the locked position to the first unlocked position;

installing a strike on the second sash, the strike including a strike opening for receiving the bolt and preventing relative movement of the window sashes;

moving the bolt a first distance away from the second sash to the first unlocked position when the sashes are in the closed position to engage the clip surface with the first stop surface and hold the bolt in the first unlocked position;

moving the first sash with respect to the second sash from the closed position towards the open position;

rotating the trigger in a first direction as the first sash moves away from the closed position towards the open position and thereby releasing the bolt from the fast unlocked position to move to the second unlocked position and engage the clip surface with the second stop surface to hold the bolt in the second unlocked position;

moving the first sash with respect to the second sash from the open position to the closed position; and rotating the trigger in an opposite direction from the first direction as the fast sash reaches the fully closed position and thereby releasing the bolt from the second unlocked position to the locked position to engage the strike.

15. The method for locking and unlocking window sashes according to claim 14, wherein the clip is positioned on a beam and the beam is cantilevered from the bolt.

16. The method for locking and unlocking window sashes according to claim 15, wherein the beam flexes about a pivot point at a juncture of the bolt and the beam.

17. The method for locking and unlocking window sashes according to claim 14, wherein the trigger further includes at least one axle for rotation about the axis.

18. The method for locking ad unlocking window sashes according to claim 14, wherein the first and second stops further include respective forward facing ramp surfaces.

19. The method for locking and unlocking window sashes according to claim 14, wherein the clip is wider than the first stop.

20. The method for locking and unlocking window sashes according to claim 19 wherein the second stop is mounted fixed relative to the chassis.

21. The method for locking and unlocking window sashes according to claim 20 wherein the second stop is mounted approximately adjacent to, but offset in a forward direction relative to the first stop and the clip surface is wider than the first stop surface, the clip surface engaging the first stop surface along a first portion of the clip surface width when the bolt is in the first unlocked position and engaging the second stop surface along a second portion of the clip surface width when the bolt is in the second unlocked position.

* * * * *